US009673003B2

(12) United States Patent
McGann et al.

(10) Patent No.: US 9,673,003 B2
(45) Date of Patent: Jun. 6, 2017

(54) ELECTRIC SWITCH FOR HIGH CURRENTS, IN PARTICULAR WITH A HIGH SHORT CIRCUIT WITHSTAND PERFORMANCE IN THE KA-RANGE

(71) Applicants: Tyco Electronics UK Ltd., Wiltshire (GB); Raychem International, Limerick (IE)

(72) Inventors: Melvyn McGann, Chelmsford (GB); Brendan Normoyle, Limerick (IE); Leslie Allen, Clackton-on-Sea (GB)

(73) Assignees: Raychem International, Limerick (IE); Tyco Electronics UK Ltd., Wiltshire (GB)

( * ) Notice: Subject to any disclaimer, the term of this patent is extended or adjusted under 35 U.S.C. 154(b) by 305 days.

(21) Appl. No.: 14/141,911

(22) Filed: Dec. 27, 2013

(65) Prior Publication Data

US 2014/0110377 A1 Apr. 24, 2014

Related U.S. Application Data

(63) Continuation of application No. PCT/EP2012/062640, filed on Jun. 28, 2012.

(30) Foreign Application Priority Data

Jun. 29, 2011 (EP) ..... 11171944

(51) Int. Cl.
*H01H 1/06* (2006.01)
*H01H 33/06* (2006.01)
(Continued)

(52) U.S. Cl.
CPC ..... *H01H 33/06* (2013.01); *H01H 1/40* (2013.01); *H01H 9/32* (2013.01); *H01H 1/44* (2013.01); *H01H 3/28* (2013.01)

(58) Field of Classification Search
CPC .. H01H 3/00; H01H 3/02; H01H 3/12; H01H 15/00; H01H 15/10; H01H 15/24;
(Continued)

(56) References Cited

U.S. PATENT DOCUMENTS 2,156,902 A * 5/1939 Popp ..... H01H 17/00 200/267
4,704,503 A * 11/1987 Takasawa ..... H01H 15/06 200/16 B
(Continued)

FOREIGN PATENT DOCUMENTS

EP 0450104 A1 10/1991
GB 2352879 A 7/2001
(Continued)

OTHER PUBLICATIONS

PCT Notification Concerning Transmittal of International Preliminary Report on Patentability, Application No. PCT/EP2011/062640, dated Jan. 16, 2014, 6 pages.
(Continued)

*Primary Examiner* — Anthony R. Jimenez
(74) *Attorney, Agent, or Firm* — Barley Snyder

(57) ABSTRACT

The present invention relates to an electric switch having a first contact element, an insulating element, and a second contact element. The first contact element includes a first contact surface on which the insulating element is disposed. The second contact element includes a conductive member moveable relative to the first contact element and the insulating element.

10 Claims, 6 Drawing Sheets

(51) Int. Cl.

| | |
|---|---|
| ***H01H 1/40*** | (2006.01) |
| ***H01H 9/32*** | (2006.01) |
| *H01H 1/44* | (2006.01) |
| *H01H 3/28* | (2006.01) |

(58) Field of Classification Search

CPC ..... H01H 15/06; H01H 69/00; H01H 71/00; H01H 71/10; H01H 71/08; H01H 71/58; H01H 1/40; H01H 1/44; H01H 33/06; H01H 9/32; H01H 3/28; H01H 37/76; H01H 85/00; H01H 1/22; H01H 1/18; H01H 1/36; H01H 1/38; H01H 1/42; H01H 15/04; H01H 2205/012; H01H 2205/006; H01H 2205/016; H01H 2205/028; H01H 2211/00; H01H 2211/012; H01H 2211/02; H01H 1/365; H01H 9/302; H01H 9/342; H01H 9/362

USPC ..... 200/275, 502, 5 R, 5 EA, 537, 547, 549, 200/550, 16 E, 178, 51 R, 51.02, 531, 200/563, 252, 241; 218/90, 57, 51; 337/401, 4, 403; 439/188, 66

See application file for complete search history.

(56) References Cited

U.S. PATENT DOCUMENTS

| | | | | |
|---|---|---|---|---|
| 5,818,148 | A * | 10/1998 | Shiomi | 310/328 |
| 7,055,812 | B2 * | 6/2006 | Balsells | 267/167 |
| 7,220,926 | B2 * | 5/2007 | Mano | H01H 15/06 200/16 D |
| 2007/0246331 | A1 * | 10/2007 | Bennetti | 200/4 |
| 2011/0266120 | A1 * | 11/2011 | Nakauchi et al. | 200/252 |
| 2013/0126326 | A1 * | 5/2013 | Borg | 200/547 |

FOREIGN PATENT DOCUMENTS

| | | | |
|---|---|---|---|
| WO | 2006027625 | A1 | 3/2006 |
| WO | WO 2010092682 | A1 * | 8/2010 |
| WO | WO 2011064510 | A1 * | 6/2011 |

OTHER PUBLICATIONS

PCT Notification of Transmittal of the International Search Report and the Written Opinion of the International Searching Authority, International Search Report and Written Opinion, International Application No. PCT/EP2012/062640, dated Oct. 22, 2012, 9 pages.

* cited by examiner

ELECTRIC SWITCH FOR HIGH CURRENTS, IN PARTICULAR WITH A HIGH SHORT CIRCUIT WITHSTAND PERFORMANCE IN THE KA-RANGE

CROSS-REFERENCE TO RELATED APPLICATIONS

This application is a continuation of PCT International Application No. PCT/EP2012/062640 filed Jun. 28, 2012, which claims priority under 35 U.S.C. §119 to European Patent No. 11171944.9 filed Jun. 29, 2011.

FIELD OF INVENTION

The invention relates to an electric switch and, in particular, an electrical switch with a short circuit for high currents.

BACKGROUND

Electric switches for high currents are well known. and are for example used in the public utility low voltage (LV) alternating current (AC) networks provided by national electricity companies. For example, switches that contain a spring have been used, where the spring, which is mounted parallel to a contact surface of a contact element, makes contact between two contact elements during a closed position by contacting both contact surfaces, and in which no mechanical or electrical contact exists in the open position. Switches of this type have a profile which requires a very high compression force to prevent inadvertent opening of the contacts during high short circuit currents, a fault situation, and the application of these high forces requires a larger actuator device to achieve this. Furthermore, such a profile makes them difficult and unsafe to operate. For example in many switches, it is possible to move the switch from the open to the closed position with negligible force, but moving into and out of the closed position requires a high force.

SUMMARY

Accordingly, the object of the present invention, among others, is to an electric switch having a permanent mechanical contact between contact elements in a closed and open position.

The electric switch includes a first contact element, an insulating element, and a second contact element. The first contact element includes a first contact surface on which the insulating element is disposed. The second contact element includes a conductive member moveable relative to the first contact element and the insulating element.

BRIEF DESCRIPTION OF THE DRAWINGS

The invention will be described hereinafter in greater detail and in an exemplary manner using advantageous embodiments and with reference to the drawings. The described embodiments are only possible configurations in which, however, the individual features as described above can be provided independently of one another or can be omitted in the drawings: In the drawings.

DETAILED DESCRIPTION OF THE EMBODIMENT(S)

Figure 1:
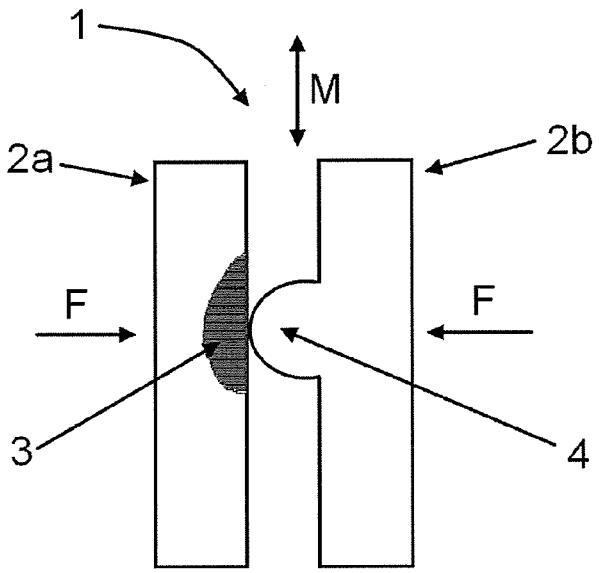
FIG. 1 is a side view of a simple switch according to the invention.

First, with reference to FIG. 1, the invention will be described by way of a simple switch according to the invention.

An electric switch 1 is adapted to be connected to an electric circuit with two contact elements 2*a*, 2*b*. The contact elements 2*a*, 2*b* are pushed against each other by a contact force F and relatively moveable to one another in the direction M.

An insulating element 3 is provided in the contact element 2*a*, and the contact element 2*b* has a protrusion 4 on the electrically conductive surface thereof. The switch 1 is depicted in an electrically open position, as the protrusion 4 of the contact element 2*b* rests on an insulating element 3 of the contact element 2*a*. In FIG. 1, the protrusion 4 is integral to the contact element 2*a*, however, one skilled in the art should appreciate that the protrusion 4 may be a separate component. Although the switch is electrically open, the contact elements 2*a*, 2*b* are still in mechanical contact due to the contact force F acting upon the two. The switch 1 can be brought into an electrically closed position by moving one of the contact elements 2*a*, 2*b* relatively to the other contact element 2*a*, 2*b* in the direction M. During this translational movement, the mechanical contact between the two contact elements 2*a*, 2*b* is maintained.

The insulating element 3 can be permanently attached to the contact element 2*a* for example by gluing, soldering, welding or by a chemical connection between the contact element 2*a* and the insulating element 3. The insulating element 3 may also be removeably attached to the contact element 2*a*, for example by designing the shape of the insulating element 3 and the contact element 2*a* such that they are complementary and engage in a form fit.

The surface of the insulating element 3 may be flush with the surface of the contact element 2*a*. This minimises the force required to move the switch 1 from the open to the closed position. However, for example if a haptic feedback for the operator is desired, discontinuities in the direction perpendicular to the direction of travel might be preferred.

Figure 2:
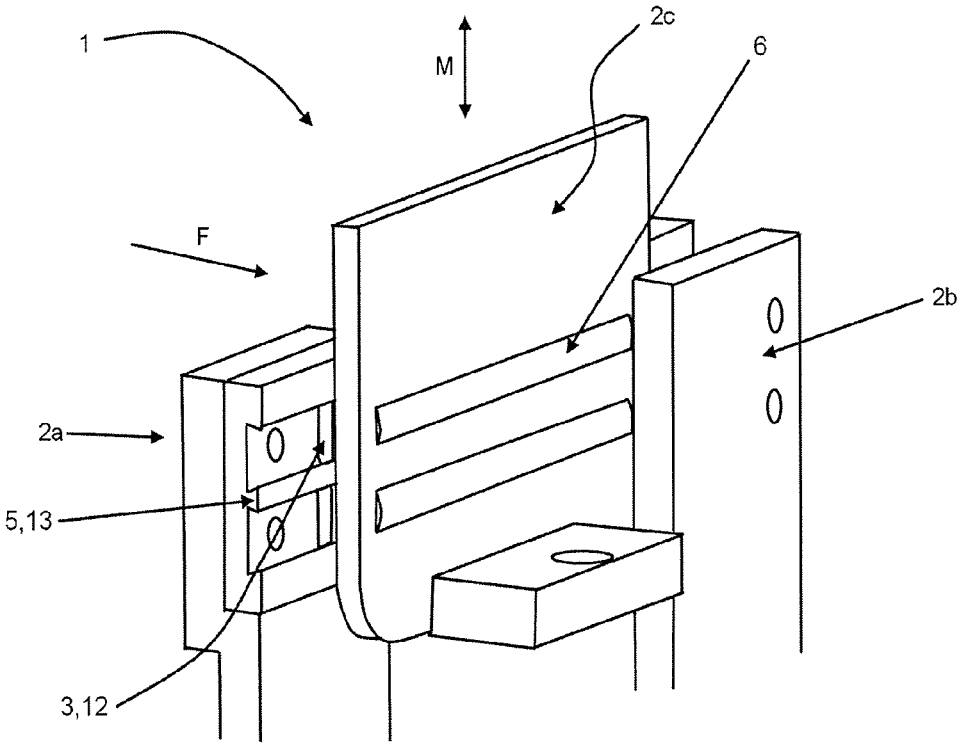
FIG. 2 is a perspective view of a switch according to the invention.
Figure 4:
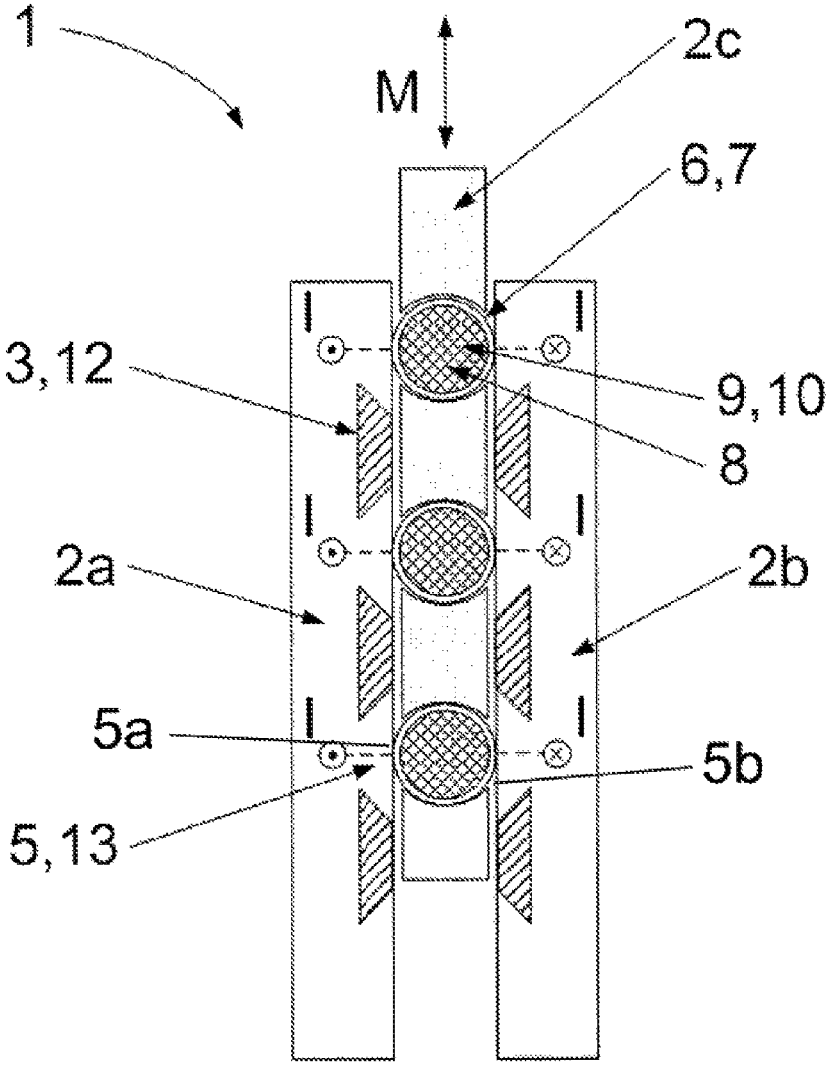
FIG. 4 is a sectional side view of a switch according to the invention.

Now with FIG. 2 and FIG. 4, another switch 1 according to the invention is shown. The switch 1 in the shown embodiment includes three contact elements 2*a*, 2*b*, 2*c*. A part of the contact element 2*b* is not shown in FIG. 2, so that the contact element 2*c* can be seen. The contact surfaces 5*a*, 5*b* of the contact elements 2*a*, 2*b* are facing each other and are planar and parallel to each other. The contact elements 2*a*, 2*b* are mainly made from metal, but contain insulating strips 12 as insulating elements 3, which are embedded into the contact elements 2*a*, 2*b* by way of form fit. In the shown embodiment, the insulating elements 3 have a dovetail profile which fits snugly into a correspondingly designed rail-like cavity of the contact elements 2. This design allows for easy removal and insertion of different insulating elements 3 into the contact elements 2*a*, 2*b*. The conductive area of the contact elements 2*a*, 2*b* may be plated for example with silver in order to lower the ohmic resistance of the contact element and to avoid degradation of the contact element.

A third contact element 2*c* is positioned between the contact elements 2*a*, 2*b* and is relatively moveable with respect to the contact elements 2*a*, 2*b*. The body of this third contact element 2*c* can contain an insulating material with one or more, in the example of FIG. 2, two, cut out portions into which electrically conductive contact members 6 may be inserted. These cut out portions can, for example, be slit-shaped. In this shown embodiment, the contact members 6 are made up of coil springs 7, the interior chamber 8 of these being filled with a stabilizing member 9, in the shape of a cylinder 10.

In a shown embodiment of the invention, the coil springs 7 are canted, that means they are sheared in the direction of the longitudinal axis of the spring, but the inclined windings of the spring should not touch each other. Canted springs are more elastic in the direction of the current path than a basically stiff non-canted springs. However, excessive canting should be avoided. In particular, the windings or turns should not touch each other, as the compressibility will be lost, which can possibly lead to a damaging of the structure. The canting may be inherent to the spring or can be caused by forces acting upon it The third contact element 2*c* may be translationally moved in the direction M, either manually or by means of an actuator assembly 11 (not shown). This makes or breaks the electric conduction between the contact elements 2*a*, 2*b* by relatively moving them from a position in which the coil springs 7 of the contact element 2*c* rest upon the insulating elements 3 of the contact elements 2*a*, 2*b* to a position where the electrically conductive coil springs 7 each contact a conductive contact area 5 of the contact elements 2*a*, 2*b*. As the contact member 6 is elastically deformable, it generates a force F necessary to maintain mechanical contact between the contact elements 2*a*, 2*b*, 2*c*.

As shown in FIG. 2 and FIG. 4, a plurality of conductive and insulating areas on the contact elements 2*a*, 2*b*, with two insulating strips and two conductive strips, co-act with two coil springs 7. The number of insulating elements 3 and conductive contact surfaces 5 of the corresponding contact elements 2 can be adjusted to a desired performance of the switch 1, in particular to the maximum current that can flow through the switch. For example, a higher number of contact members can be used, if more current is supposed to flow.

The surfaces of the insulating elements 3 can be flush with the rest of the surface of the contact element 2*a*, 2*b*. This facilitates movement of the third contact element 2*c* with respect to the two first contact elements 2*a*, 2*b* as no discontinuities in a direction perpendicular to the direction of the translational motion M have to be overcome. However, for some applications it might be favourable if the operator gets a haptic feedback, so a design in which small discontinuities have to be overcome, might be preferred.

In the shown embodiment, the plurality of conductive and insulating strips in FIG. 2 and FIG. 4 are arranged such that the insulating strips 12 and the conductive strips 13 are alternating, that means an insulating strip 12 is located between two conductive strips 13 and vice versa. The elongation of the insulating strips 12 and the conductive strips 13 is parallel to the elongation of the contact member 6 of the third contact element 2*c*, which ensures proper engagement of the coil springs 7 of the third contact element 2*c* with the insulating strips 12 and the conductive strips 13, respectively, of the contact elements 2*a*, 2*b*.

The coil springs 7 that are used as contact members 6 in the contact element 2*c* may have uniform windings, so that the force they exert on the contact elements 2*a*, 2*b* is uniform along the elongation of the coil spring. However, the winding density can vary along the elongation of the springs, if an accumulation of contact force and thus of the electric conductivity in some areas is preferred.

A configuration of a switch 1 as depicted in FIG. 2 or FIG. 4 provides a current path I that enters and exits the contact surfaces 5 of the conductive strips 13 of the contact elements 2*a*, 2*b* perpendicularly and which has only a short distance between two opposing conductive strips 13 of the contact elements 2*a*, 2*b*. This simple path reduces unwanted, magnetically induced mechanical forces when high currents are flowing. Thus, movement of the third contact element 2*c* by these induced mechanical forces is minimised.

Additionally, a switch 1, which is designed as depicted in FIG. 2 with two contact elements 2*a*, 2*b* each with an L-like shape ensures a uniform distribution of the contact force F along the contact area between the contact members 6 and the conductive strips 13 and hence minimizes contact degradation due to a varying force profile along the elongation of the contact members 6 and the conductive strips 13.

The contact element 2*c* can be by an actuator assembly 11 for example electrically, mechanically, pneumatically or manually. The direction of the movement M is preferentially linear in this configuration. However, the design of the switch 1 can be such that a rotational movement of one contact element 2 is favourable, for example the contact element 2 might be designed in a disc-like shape.

The actuator assembly 11 can be adapted to the properties of the switch 1, in particular to the contact force F exerted by the contact members 6. The force F exerted by the actuator assembly 11 can exceed the force that can be exerted by a human operator.

Using an actuator assembly 11 may allow the operator to operate the switch 1 at a distance, which makes the operation of the switch 1 safer as potentially dangerous and harmful currents can flow through the switch 1. Additionally, the switch 1 can be located in a housing or in a position far away from the operator.

Figure 3:
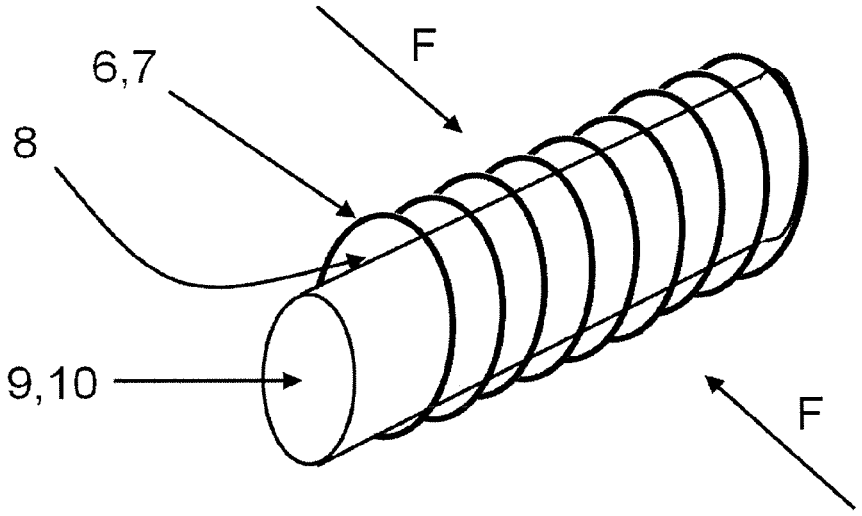
FIG. 3 is a perspective view of a contact member according to the invention.

Now with reference to FIG. 3, a contact member 6 for a switch 1 according to the invention is shown. As shown, the contact member 6 is a coil spring 7. The volume surrounded by the inner contour of the coil spring 7 represents the interior chamber 8 into which the outer contour of a stabilizing member 9 can be inserted. In the shown embodiment, the stabilizing member 9 is a cylinder 10 with a circular or oval base. This helps to minimise the extent to which the contact member 6 is deformed in the direction of the force F acting perpendicular to the axis of the coil spring 7.

The material of the stabilizing member 9 can be chosen from a variety of materials. For example the stabilizing member 9 may be conductive or non-conductive, or it can be stiff or soft. Additionally, the material may be chosen such that other properties of the material are advantageous for the purpose of the switch 1. It can for example be advantageous in some applications if the material is form-stable in the temperature range of operation of the switch 1. Silicone-rubber may be used as a material for the stabilizing member.

In the shown embodiment, the stabilizing member 9 is designed to fit snugly into the coil spring 7, thus providing little space for movement of the two with respect to the other which increases contact force. In case the coil spring 7 is mounted with the longitudinal axis parallel to the contact surface 5 of the contact element 2, a spring with many windings may be used. This provides many possible current paths in parallel and thus gives a low overall electric resistance of the contact member 6 and the switch 1.

With reference back to FIG. 4, a switch 1 similar to the configuration shown in FIG. 2 is depicted. In the shown embodiment, the number of contact members 6 and insulating elements 3 and conductive contact surfaces 5 of the contact elements 2*a*, 2*b* is increased to three, which increases the possible current flowing through the switch.

The switch 1 is shown in an electrically closed position in which a current can flow along the current path I from contact element 2*a* via contact element 2*c* to contact element 2*b*, where the current can flow exclusively through the contact member 6, embodied as a coil spring 7, as the other parts of the contact element 2*c* are made from an insulating material. In particular, the stabilizing member 9 which is cylindrical also consists of an insulating material, for example silicone-rubber. The windings of the coil spring 7 are the only paths for the current. This gives a well defined current path I and avoids localized high current densities in parts of the switch 1. High current densities, which might cause arcing, welding or contact degradation are avoided.

By choosing a coil spring 7 with a constant winding density as a contact member 6 and a uniformly distributed contact force F, the distribution of the current density is also uniform along the contact surface 5 of the contact member 6. This avoids an inhomogeneous current distribution along the contact surface 5 and hence minimises the temperature rise and avoids arcing and welding, which might occur due to localised high current densities and lead to contact degradation.

In order to open or close the switch, the contact element 2*c* can be moved along the direction M, which positions the contact member 6 of the contact element 2*c* either in electric contact with each of the contact elements 2*a*, 2*b* or only in mechanical contact with the insulating elements 3 of the contact elements 2*a*, 2*b*. During the entire travel of the contact element 2*c*, each of the contact elements 2*a*, 2*b* is in permanent contact with the contact element 2*c*, which gives a well-defined and predictable force profile when moving from the open to the closed position, improving the ease of use of the switch 1 for the operator.

The fact that the current flows from contact element 2*a* to contact element 2*b* along a very short path, which is perpendicular to the contact surfaces 5 of the contact elements 2, minimizes unwanted magnetically induced mechanical forces, in particular if high currents are flowing.

Figure 5:
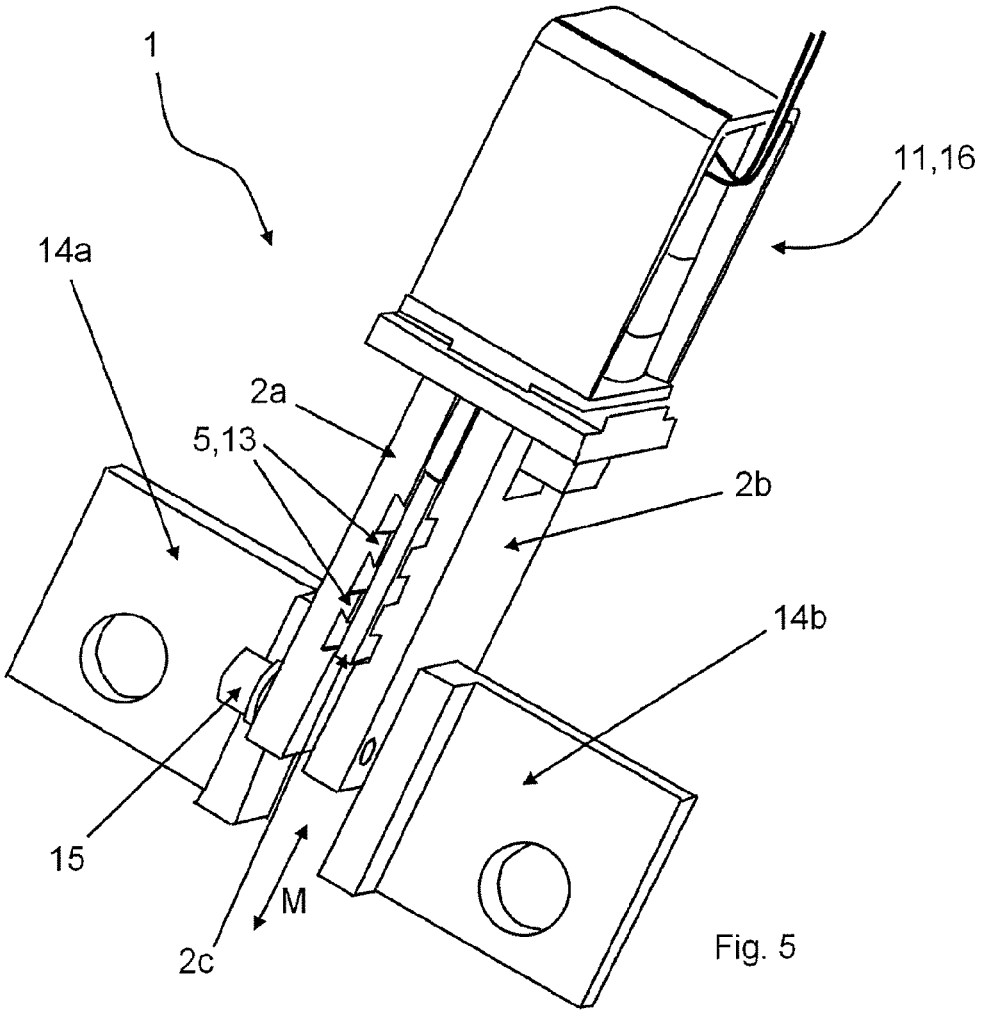
FIG. 5 is a perspective view of another switch according to the invention.

With reference to FIG. 5 another switch 1 according to the invention is depicted. Each of the contact elements 2*a*, 2*b* is electrically connected to an electric circuit using mechanical or braising means and separated from the supports 14*a*, 14*b* by the insulating bushings 15. The two contact elements 2*a*, 2*b* face each other and are separated. The sides of the contact elements 2*a*, 2*b* that face each other exhibit a plurality of alternating conductive strips 13 and insulating strips 12. A third contact element 2*c* is positioned between the two contact elements 2*a*, 2*b* a. The third contact element 2*c* is connected to a solenoid coil that can move the third contact element 2*c*. The contact element 2*c* may have elongated cut out portions which provide space for contact members 6. The actuator assembly 11, embodied as an electrically driven solenoid coil 16, can move the third contact element 2*c* translationally and in a direction M perpendicular to the elongation of the conductive strips 13 and the insulating strips 12 and perpendicular to the current path I. This makes or breaks the electric conductivity between contact element 2*a* and 2*b* by positioning the contact members 6 located in the third contact element 2*c* from a position where they rest on the insulating strips 12 to a position where they rest on the conductive strips 13 or vice versa, respectively.

The actuator assembly 6, which is electrically driven, is located away from the area of strong magnetic fields induced by the high currents that are flowing in the switch 1. This prevents faulty operation of the electrically driven actuator assembly 11 which might be caused by induced currents.

Figure 6:
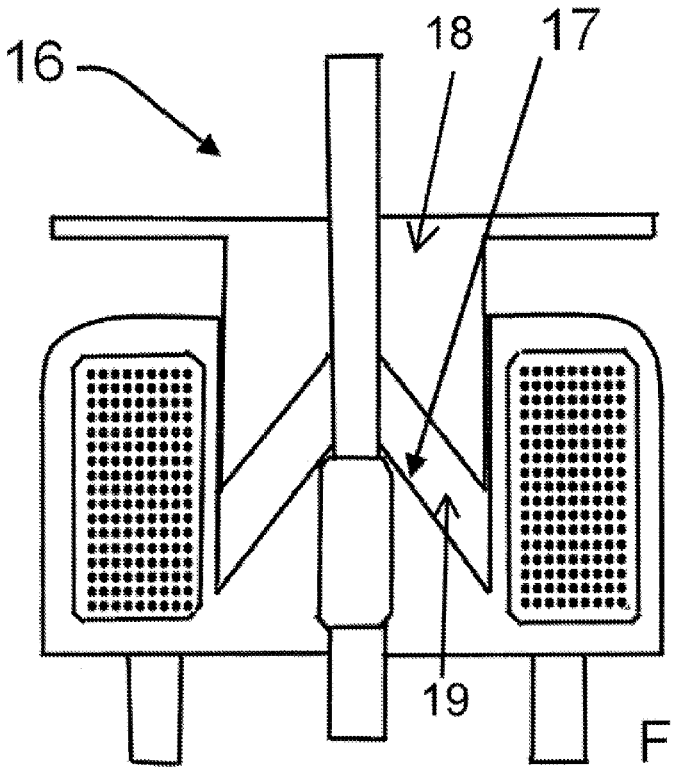
FIG. 6 is a sectional side view of a solenoid coil with a conical face

Now with reference to FIG. 6 the solenoid coil 16 is depicted. A contact area 19 is where a moveable part 18 and a resting part 17 face each other. In the shown embodiment of FIG. 6, the length in the center of the moveable part 18 is shorter than at the circumference. However, a design in which the center is longer than the circumference is also possible.

The elastic deformability of the contact member 6 can be inherent to the material from which the contact member 6 is made or it can be a result of the microscopic structure of the material, for example metallic sponges might be chosen. However, as most electrically conductive materials show little elasticity and creating a microscopic structure might be complicated and time consuming, the elastic deformability of the contact element is preferentially due to its shape. Several different types of spring elements might be used as contact members 6, including those that are easy to manufacture, for example spring elements made, as discussed, from wire material or sheet metal.

Accordingly, the spring constant can be adjusted so that the contact force exerted by the coil spring 7 is customized to a desired force or force profile. Soft springs with a low spring constant can be used if weak contact forces are desirable, for example if an easy movement of the contact member is necessary, stiff springs with a high spring constant can be used if a high contact force and thus a good electric contact is necessary. Coil springs 7 with different diameters, spring constants and length are readily available with a wide choice in materials, so no extra step in manufacturing the switch 1 is needed, which reduces the time and costs to produce the switch.

Additionally, the stabilizing member 9 can be made from an elastically deformable material. This increases the contact force when the contact member 6 is compressed and thus leads to a tight contact, but allows for small movements in the direction of compression without losing electrical contact.

The choice of material for the stabilizing member 9 can be guided by the requirements of the switch like the maximum allowed current or the temperature range in which it is operated. For example, it can be chosen such that it is form-stable in the operating range of the switch. Additionally, a chemically inert material may be used, especially if the switch 1 is located in an aggressive, e.g. a corrosive environment. In an embodiment of the invention, the stabilizing member 9 might be made from silicone-rubber. This choice ensures safe operation of the switch 1 in the room temperature range, as this material is temperature-stable at room temperature.

The stabilizing member 9 may be a cylinder such that forces acting upon the stabilizing member 9, perpendicular to its longitudinal axis, do not result in a movement of the stabilizing member 9. Furthermore, if the stabilizing member 9 is removable, the cylindrical shape allows for easy insertion and removal of the stabilizing member 9 into and out of the interior chamber 8 if the chamber 8 is accessible from the outside. Additionally, in case a uniformly wound coil spring 7 is used, this shape returns a uniform force distribution along the longitudinal axis if the stabilizing member 9 is subjected to uniform external forces in a direction perpendicular to the longitudinal axis, thus avoiding higher contact forces on some parts of the contact surface. Cylindrical shapes are easy to manufacture and can for example be cut from a continuous supply, thus lowering the manufacturing costs and time. In a shown embodiment of the invention, a cylindrical stabilizing member 9 with a circular or oval base is received in the volume surrounded by a coil spring 7. This combination gives a minimum of manufacturing time and cost and a maximum of user comfort, as it allows for an easy exchange of the stabilizing member and the contact member. Especially a combination of a coil spring 7 with a stabilizing member 9 that fits snugly into the coil spring 7 is favourable, as such a tight fit ensures little movement relative to each other and thus a higher contact force is achieved and wear is minimized. However, there may be a loose fit between the stabilizing member 9 and the coil spring 7 in the uncompressed state, as this allows for an easy exchange of the stabilizing member 9, while the contact force enhancement is still present in the compressed state.

In order to further minimize the electrical resistance in the switch 1, the contact members 6 and/or the contact areas 5 can be plated e.g. with materials that have high electric conductivity and/or high hardness and/or resistance to degradation. Such a material could for example be silver, as this material has a high electric conductivity and a high resistance to oxidation, which can be a part of contact degradation.

Although several embodiments have been shown and described, it would be appreciated by those skilled in the art that various changes or modifications may be made in these embodiments without departing from the principles and spirit of the disclosure, the scope of which is defined in the claims and their equivalents.

What is claimed is:

1. An electric switch comprising:

a first contact element having a first contact surface;

an insulating element disposed along the first contact surface and removeably embedded in the first contact element; and a second contact element having a conductive member protrusion, being moveable relative to the first contact element and the insulating element.

2. The electric switch according to claim 1, wherein the insulating element and the first contact element are complementary and engage in a form fit.

3. The electric switch according to claim 1, wherein an engaging surface of the insulating element is flush with the first contact surface.

4. An electric switch comprising:

a first planar surface including a first contact element and a first insulating element disposed along the first planar surface;

a second planar surface including a second contact element, the second planar surface parallel to and facing the first planar surface; and a third contact element having an insulating portion, a cut out portion extending through the insulating portion, and an electrically conductive contact member disposed in the cut out portion, the third contact element being moveable between the first and second contact elements.

5. The electric switch according to claim 4, further comprising an actuator assembly connected to the third contact element and moving the electrically conductive contact member relative to first and second planar surfaces.

6. The electric switch according to claim 4, wherein the second planar surface includes a second insulating element disposed with the second contact element along the second planar surface.

7. The electric switch according to claim 6, wherein the first insulating element is removeably attached to the first planar surface.

8. The electric switch according to claim 7, wherein the first insulating element and the first contact element are complementary and engage in a form fit.

9. The electric switch according to claim 4, wherein the electrically conductive contact member includes a coil spring with a stabilizing member.

10. The electric switch according to claim 9, wherein the coil spring is canted.

* * * * *